US006314924B1

(12) United States Patent
Berlinger

(10) Patent No.: US 6,314,924 B1
(45) Date of Patent: Nov. 13, 2001

(54) METHOD OF OPERATING A FREE PISTON INTERNAL COMBUSTION ENGINE WITH A SHORT BORE/STROKE RATIO

(75) Inventor: Willibald G. Berlinger, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/255,523

(22) Filed: Feb. 22, 1999

(51) Int. Cl.[7] ..... F02B 71/00
(52) U.S. Cl. ..... 123/46 R; 123/46 SC
(58) Field of Search ..... 123/46 R, 46 SC

(56) References Cited

U.S. PATENT DOCUMENTS

| | | | | |
|---|---|---|---|---|
| 4,016,719 | | 4/1977 | Yavnai . | |
| 4,020,804 | * | 5/1977 | Bailey | 123/46 R |
| 4,435,133 | | 3/1984 | Meukendyk . | |
| 4,589,380 | * | 5/1986 | Coad | 123/46 R |
| 4,620,836 | | 11/1986 | Brandl . | |
| 4,724,800 | * | 2/1988 | Wood | 123/59.7 |
| 5,540,194 | * | 7/1996 | Adams | 123/46 R |
| 5,556,262 | | 9/1996 | Achten et al. . | |
| 5,775,273 | | 7/1998 | Beale | 123/46 B |

FOREIGN PATENT DOCUMENTS

WO 98/46870 10/1998 (WO) .

OTHER PUBLICATIONS

TU Dresden—publication date unknown—earliest date 1993—Dresden University in Germany.
Application No. 08/974,326, filed Nov. 19, 1997, entitled "Two Cycle Engine Having a Mon–Valve Integrated Withy a Fuel Injector".

* cited by examiner

*Primary Examiner*—Willis R. Wolfe
*Assistant Examiner*—Jason Benton
(74) *Attorney, Agent, or Firm*—Taylor & Aust, P.C.

(57) ABSTRACT

A method of operating a free piston internal combustion engine includes the steps of: providing a housing with a combustion cylinder and a second cylinder, the combustion cylinder having a bore with an inside diameter; providing a piston including a piston head reciprocally disposed within the combustion cylinder, a second head reciprocally disposed within the second cylinder, and a plunger rod interconnecting the piston head with the second head; and moving the piston between a top dead center position and a bottom dead center position during a return stroke, the return stroke having a stroke length between the top dead center position and the bottom dead center position, the moving step being carried out with a bore/stroke ratio represented by a quotient of the inside diameter divided by the stroke length which is between 1.2 and 1.5. An air scavenging port is in fluid communication with the bore during between 50 and 70 percent of a cycle time period.

13 Claims, 5 Drawing Sheets

METHOD OF OPERATING A FREE PISTON INTERNAL COMBUSTION ENGINE WITH A SHORT BORE/STROKE RATIO

TECHNICAL FIELD

The present invention relates to free piston internal combustion engines, and, more particularly, to a method of operating a free piston internal combustion engine with a hydraulic power output.

BACKGROUND ART

Internal combustion engines typically include a plurality of pistons which are disposed within a plurality of corresponding combustion cylinders. Each of the pistons is pivotally connected to one end of a piston rod, which in turn is pivotally connected at the other end thereof with a common crankshaft. The relative axial displacement of each piston between a top dead center (TDC) position and a bottom dead center (BDC) position is determined by the angular orientation of the crank arm on the crankshaft with which each piston is connected.

A free piston internal combustion engine likewise includes a plurality of pistons which are reciprocally disposed in a plurality of corresponding combustion cylinders. However, the pistons are not interconnected with each other through the use of a crankshaft. Rather, each piston is typically rigidly connected with a plunger rod which is used to provide some type of work output. In a free piston engine with a hydraulic output, the plunger is used to pump hydraulic fluid which can be used for a particular application. Typically, the housing which defines the combustion cylinder also defines a hydraulic cylinder in which the plunger is disposed and an intermediate compression cylinder between the combustion cylinder and the hydraulic cylinder. The combustion cylinder has the largest inside diameter; the compression cylinder has an inside diameter which is smaller than the combustion cylinder; and the hydraulic cylinder has an inside diameter which is still yet smaller than the compression cylinder. A compression head which is attached to and carried by the plunger at a location between the piston head and plunger head has an outside diameter which is just slightly smaller than the inside diameter of the compression cylinder. A high pressure hydraulic accumulator which is fluidly connected with the hydraulic cylinder is pressurized through the reciprocating movement of the plunger during operation of the free piston engine. An additional hydraulic accumulator is selectively interconnected with the area in the compression cylinder to exert a relatively high axial pressure against the compression head and thereby move the piston head toward the top dead center position.

In a free piston engine as described above, the piston includes a piston head, a compression head and a plunger head which are commonly carried by a plunger rod and respectively disposed in the combustion cylinder, compression cylinder and hydraulic cylinder. The piston including the three separate heads is quite long, which increases the overall package size of the free piston engine. Moreover, as a result of the relatively large size of the piston, the mass of the piston is relatively heavy. The energy which is required for combustion of fuel within the combustion cylinder is related to the required kinetic energy of the piston when the piston is at a TDC position. The kinetic energy is a function of the mass and square of the velocity of the piston. Since the piston is relatively heavy, the piston is accelerated to a velocity which is relatively low in order to provide the kinetic energy needed for combustion. Moreover, since the piston is relatively heavy and the hydraulic fluid used to move the piston toward the TDC position is at a limited pressure, the acceleration of the piston is relatively slow and thus the stroke length is relatively long in order for the piston to reach the desired velocity. The slow acceleration, velocity and frequency of a conventional free piston engine results in a relatively low power output.

The present invention is directed to overcoming one or more of the problems as set forth above.

DISCLOSURE OF THE INVENTION

In one aspect of the invention, a method of operating a free piston internal combustion engine includes the steps of: providing a housing with a combustion cylinder and a second cylinder, the combustion cylinder having a bore with an inside diameter; providing a piston including a piston head reciprocally disposed within the combustion cylinder, a second head reciprocally disposed within the second cylinder, and a plunger rod interconnecting the piston head with the second head; and moving the piston between a top dead center position and a bottom dead center position during a return stroke, the return stroke having a stroke length between the top dead center position and the bottom dead center position, the moving step being carried out with a bore/stroke ratio represented by a quotient of the inside diameter divided by the stroke length which is between 1.2 and 1.5.

In another aspect of the invention, a method of operating a free piston internal combustion engine includes the steps of: providing a housing with a combustion cylinder and a second cylinder, the combustion cylinder having a bore and an air scavenging port in communication with the bore; providing a piston including a piston head reciprocally disposed within the combustion cylinder, a second head reciprocally disposed within the second cylinder, and a plunger rod interconnecting the piston head with the second head; and moving the piston from a bottom dead center position to a top dead center position and back to the bottom dead center position during a cycle time period, the piston head opening and closing the air scavenging port during the movement of the piston, the air scavenging port being in fluid communication with the bore during between 50 and 70% of the cycle time period.

BEST MODE FOR CARRYING OUT THE INVENTION

Figure 1:
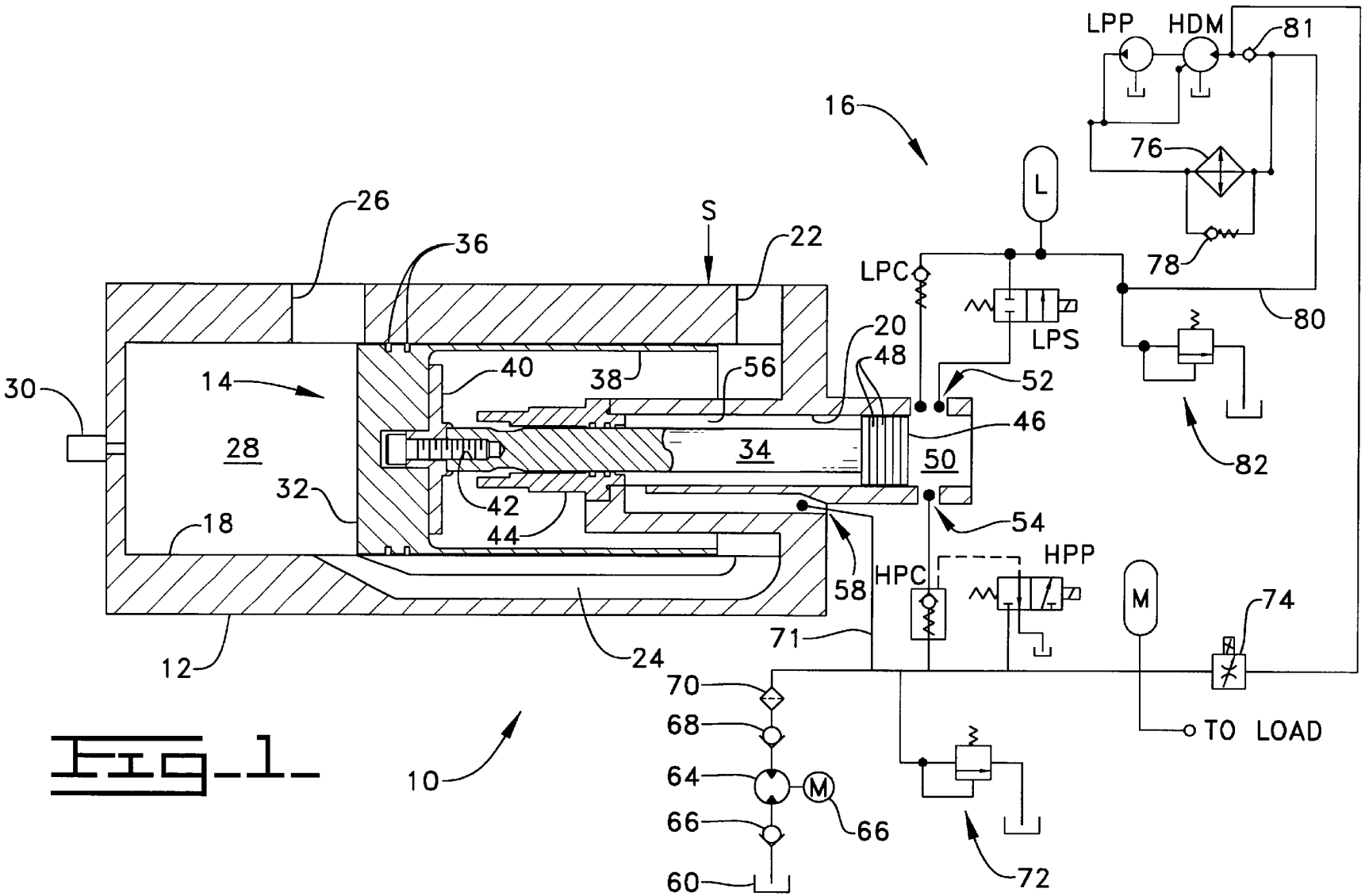
FIG. 1 is a schematic illustration of an embodiment of a free piston engine with which an embodiment of a method of the present invention may be used.

Referring now to the drawings, and more particularly to FIG. 1, there is shown an embodiment of a free piston internal combustion engine 10 which may be used with an embodiment of the method of the present invention, and which generally includes a housing 12, piston 14, and hydraulic circuit 16.

Housing 12 includes a combustion cylinder 18 and a hydraulic cylinder 20. Housing 12 also includes a combustion air inlet 22, air scavenging channel 24 and exhaust outlet 26 which are disposed in communication with a combustion chamber 28 within combustion cylinder 18. Combustion air is transported through combustion air inlet 22 and air scavenging channel 24 into combustion chamber 28 when piston 14 is at or near a BDC position. An appropriate fuel, such as a selected grade of diesel fuel, is injected into combustion chamber 28 as piston 14 moves toward a TDC position using a controllable fuel injector system, shown schematically and referenced as 30. The physical location of piston 14 at a BDC position and a TDC position, and thus the stroke length S between the BDC position and TDC position, may be fixed or variable from one stroke to another since piston 14 is not attached to or carried by a crankshaft.

Piston 14 is reciprocally disposed within combustion cylinder 18 and is moveable during a compression stroke toward a TDC position and during a return stroke toward a BDC position. Piston 14 generally includes a piston head 32 which is attached to a plunger rod 34. Piston head 32 is formed from a metallic material in the embodiment shown, such as aluminum or steel, but may be formed from another material having suitable physical properties such as coefficient of friction, coefficient of thermal expansion and temperature resistance. For example, piston head 32 may be formed from a non-metallic material such as a composite or ceramic material. More particularly, piston head 32 may be formed from a carbon-carbon composite material with carbon reinforcing fibers which are randomly oriented or oriented in one or more directions within a carbon and resin matrix.

Piston head 32 includes two annular piston ring groves 36 in which are disposed a pair of corresponding piston rings (not numbered) to prevent blow-by of combustion products on the return stroke of piston 14 during operation. Any number of piston ring grooves 36 and piston rings may be used without changing the essence of the invention. If piston head 32 is formed from a suitable non-metallic material having a relatively low coefficient of thermal expansion, it is possible that the radial operating clearance between piston head 32 and the inside surface of combustion cylinder 18 may be reduced such that piston ring grooves 36 and the associated piston rings may not be required. Piston head 32 also includes an elongated skirt 38 which lies adjacent to and covers exhaust outlet 26 when piston 14 is at or near a TDC position, thereby preventing combustion air which enters through combustion air inlet 22 from exiting exhaust outlet 26.

Plunger rod 34 is substantially rigidly attached to piston head 32 at one end thereof using a mounting hub 40 and a bolt 42. Bolt 42 extends through a hole (not numbered) in mounting hub 40 and is threadingly engaged with a corresponding hole formed in the end of plunger rod 34. Mounting hub 40 is then attached to the side of piston head 32 opposite combustion chamber 28 in a suitable manner, such as by using bolts, welding, and/or adhesive, etc. A bearing/seal 44 surrounding plunger rod 34 and carried by housing 12 separates combustion cylinder 18 from hydraulic cylinder 20.

Plunger head 46 is substantially rigidly attached to an end of plunger rod 34 opposite from piston head 32. Reciprocating movement of piston head 32 between a BDC position and a TDC position, and vice versa, causes corresponding reciprocating motion of plunger rod 34 and plunger head 46 within hydraulic cylinder 20. Plunger head 46 includes a plurality of sequentially adjacent lands and valleys 48 which effectively seal with and reduce friction between plunger head 46 and an inside surface of hydraulic cylinder 20.

Plunger head 46 and hydraulic cylinder 20 define a variable volume pressure chamber 50 on a side of plunger head 46 generally opposite from plunger rod 34. The volume of pressure chamber 50 varies depending upon the longitudinal position of plunger head 46 within hydraulic cylinder 20. A fluid port 52 and a fluid port 54 are fluidly connected with variable volume pressure chamber 50. An annular space 56 surrounding plunger rod 34 is disposed in fluid communication with a fluid port 58 in housing 12. Fluid is drawn through fluid port 58 into annular space 56 upon movement of plunger rod 34 and plunger head 46 toward a BDC position so that a negative pressure is not created on the side of plunger head 46 opposite variable volume pressure chamber 50. The effective cross-sectional area of pressurized fluid acting on plunger head 46 within variable volume pressure chamber 50 compared with the effective cross-sectional area of pressurized fluid acting on plunger head 46 within annular space 56, is a ratio of between approximately 5:1 to 30:1. In the embodiment shown, the ratio between effective cross-sectional areas acting on opposite sides of plunger head 46 is approximately 20:1. This ratio has been found suitable to prevent the development of a negative pressure within annular space 56 upon movement of plunger head 46 toward a BDC position, while at the same time not substantially adversely affecting the efficiency of free piston engine 10 while plunger head 46 is traveling toward a TDC position.

Hydraulic circuit 16 is connected with hydraulic cylinder 20 and provides a source of pressurized fluid, such as hydraulic fluid, to a load for a specific application, such as a hydrostatic drive unit (not shown). Hydraulic circuit 16 generally includes a high pressure hydraulic accumulator H, a low pressure hydraulic accumulator L, and suitable valving, etc. used to connect high pressure hydraulic accumulator H and low pressure hydraulic accumulator L with hydraulic cylinder 20 at selected points in time as will be described in greater detail hereinafter.

More particularly, hydraulic circuit 16 receives hydraulic fluid from a source 60 to initially charge high pressure hydraulic accumulator H to a desired pressure. A starter motor 62 drives a fluid pump 64 to pressurize the hydraulic fluid in high pressure hydraulic accumulator H. The hydraulic fluid transported by pump 64 flows through a check valve 66 on an input side of pump 64, and a check valve 68 and filter 70 on an output side of pump 64. The pressure developed by pump 64 also pressurizes annular space 56 via the interconnection with line 71 and fluid port 58. A pressure relief valve 72 ensures that the pressure within high pressure hydraulic accumulator H does not exceed a threshold limit.

The high pressure hydraulic fluid which is stored within high pressure hydraulic accumulator H is supplied to a load suitable for a specific application, such as a hydrostatic drive unit. The high pressure within high pressure hydraulic accumulator H is initially developed using pump 64, and is thereafter developed and maintained using the pumping action of free piston engine 10.

A proportional valve 74 has an input disposed in communication with high pressure hydraulic accumulator H, and provides the dual functionality of charging low pressure hydraulic accumulator L and providing a source of fluid power for driving ancillary mechanical equipment on free piston engine 10. More particularly, proportional valve 74 provides a variably controlled flow rate of high pressure hydraulic fluid from high pressure hydraulic accumulator H to a hydraulic motor HDM. Hydraulic motor HDM has a rotating mechanical output shaft which drives ancillary equipment on free piston engine 10 using a belt and pulley arrangement, such as a cooling fan, alternator and water pump. Of course, the ancillary equipment driven by hydraulic motor HDM may vary from one application to another.

Hydraulic motor HDM also drives a low pressure pump LPP which is used to charge low pressure hydraulic accumulator L to a desired pressure. Low pressure pump LPP has a fluid output which is connected in parallel with each of a heat exchanger 76 and a check valve 78. If the flow rate through heat exchanger 76 is not sufficient to provide an adequate flow for a required demand, the pressure differential on opposite sides of check valve 78 causes check valve 78 to open, thereby allowing hydraulic fluid to bypass heat exchanger 76 temporarily. If the pressure developed by low pressure pump LPP which is present in line 80 exceeds a threshold value, check valve 81 opens to allow hydraulic fluid to bleed back to the input side of hydraulic motor HDM. A pressure relief valve 82 prevents the hydraulic fluid within line 80 from exceeding a threshold value.

Low pressure hydraulic accumulator L selectively provides a relatively lower pressure hydraulic fluid to pressure chamber 50 within hydraulic cylinder 20 using a low pressure check valve LPC and a low pressure shutoff valve LPS. Conversely, high pressure hydraulic accumulator H provides a higher pressure hydraulic fluid to pressure chamber 50 within hydraulic cylinder 20 using a high pressure check valve HPC and a high pressure pilot valve HPP.

During an initial start-up phase of free piston engine 10, starter motor 62 is energized to drive pump 64 and thereby pressurize high pressure hydraulic accumulator H to a desired pressure. Since piston 14 may not be at a position which is near enough to the BDC position to allow effective compression during a compression stroke, it may be necessary to effect a manual return procedure of piston 14 to a BDC position. To wit, low pressure shutoff valve LPS is opened using a suitable controller to minimize the pressure on the side of hydraulic plunger 46 which is adjacent to pressure chamber 50. Since annular space 56 is in communication with high pressure hydraulic accumulator H, the pressure differential on opposite sides of hydraulic plunger 46 causes piston 14 to move toward the BDC position, as shown in FIG. 1.

When piston 14 is at a position providing an effective compression ratio within combustion chamber 28, high pressure pilot valve HPP is actuated using a controller to manually open high pressure check valve HPC, thereby providing a pulse of high pressure hydraulic fluid from high pressure hydraulic accumulator into pressure chamber 50. Low pressure check valve LPC and low pressure shutoff valve LPS are both closed when the pulse of high pressure hydraulic fluid is provided to pressure chamber 50. The high pressure pulse of hydraulic fluid causes plunger head 46 and piston head 32 to move toward the TDC position. Because of the relatively large ratio difference in cross-sectional areas on opposite sides of plunger head 46, the high pressure hydraulic fluid which is present within annual space 56 does not adversely interfere with the travel of plunger head 46 and piston head 32 toward the TDC position. The pulse of high pressure hydraulic fluid is applied to pressure chamber 50 for a period of time which is sufficient to cause piston 14 to travel with a kinetic energy which will effect combustion within combustion chamber 28. The pulse may be based upon a time duration or a sensed position of piston head 32 within combustion cylinder 18.

As plunger head 46 travels toward the TDC position, the volume of pressure chamber 50 increases. The increased volume in turn results in a decrease in the pressure within pressure chamber 50 which causes high pressure check valve HPC to close and low pressure check valve LPC to open. The relatively lower pressure hydraulic fluid which is in low pressure hydraulic accumulator L thus fills the volume within pressure chamber 50 as plunger head 46 travels toward the TDC position. By using only a pulse of pressure from high pressure hydraulic accumulator H during a beginning portion of the compression stroke (e.g., during 60% of the stroke length), followed by a fill of pressure chamber 50 with a lower pressure hydraulic fluid from low pressure hydraulic accumulator L, a net resultant gain in pressure within high pressure hydraulic accumulator H is achieved.

By properly loading combustion air and fuel into combustion chamber 28 through air scavenging channel 24 and fuel injector 30, respectively, proper combustion occurs within combustion chamber 28 at or near a TDC position. As piston 14 travels toward a BDC position after combustion, the volume decreases and pressure increases within pressure 50. The increasing pressure causes low pressure check valve LPC to close and high pressure check valve HPC to open. The high pressure hydraulic fluid which is forced through high pressure check valve during the return stroke is in communication with high pressure hydraulic accumulator H, resulting in a net positive gain in pressure within high pressure hydraulic accumulator H.

Figure 2:
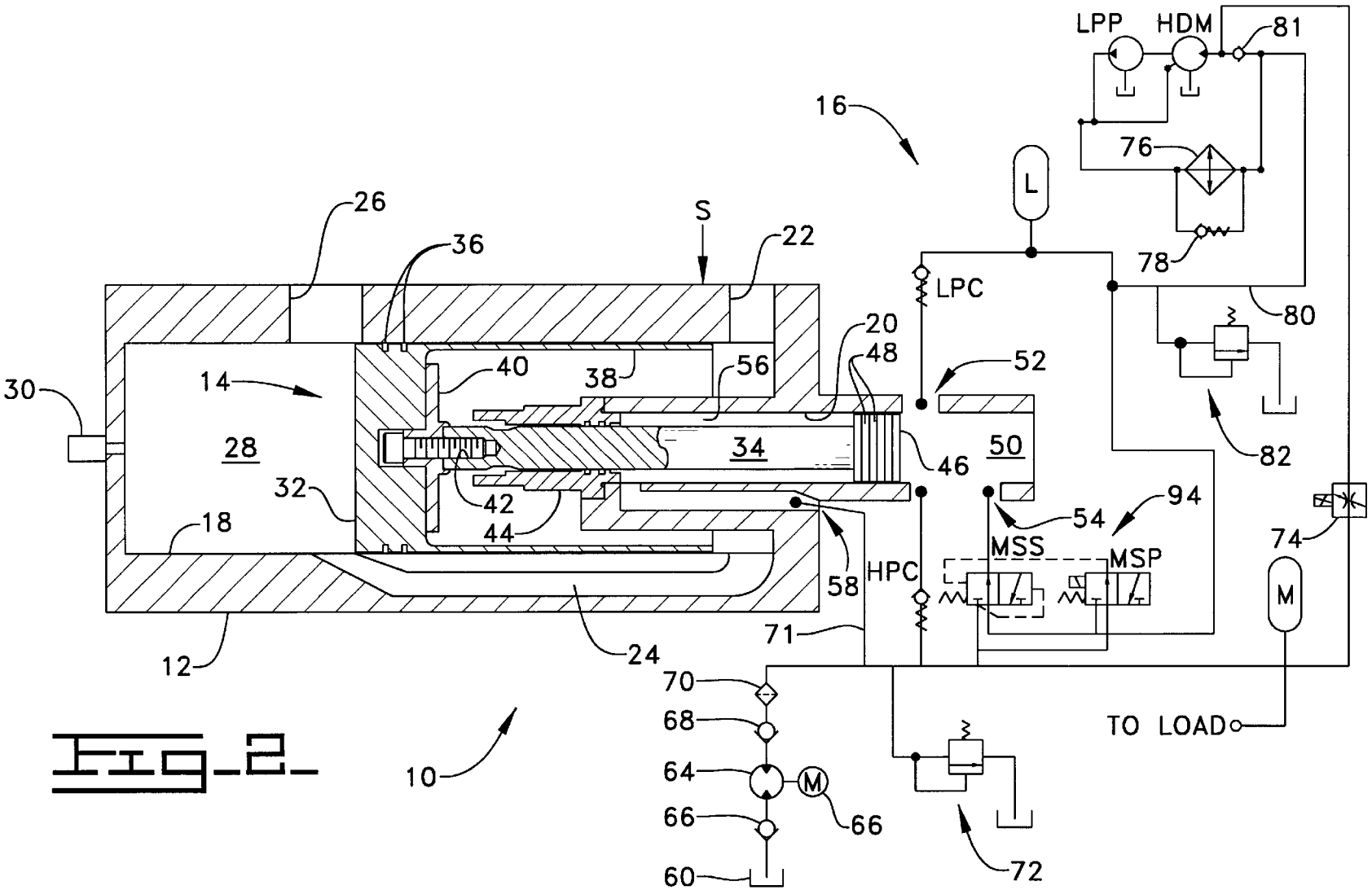
FIG. 2 is a schematic illustration of another embodiment of a free piston engine with which another embodiment of a method of the present invention may be used.

FIG. 2 illustrates another embodiment of a free piston internal combustion engine 90 which may be used with an embodiment of the method of the present invention, and which includes a combustion cylinder and piston arrangement which is substantially the same as the embodiment shown in FIG. 1. Hydraulic circuit 92 of free piston engine 90 also includes many hydraulic components which are the same as the embodiment of hydraulic circuit 16 shown in FIG. 1. Hydraulic circuit 92 principally differs from hydraulic circuit 16 in that hydraulic circuit 92 includes a mini-servo valve 94 with a mini-servo main spool MSS and a mini-servo pilot MSP. Mini-servo main spool MSS is controllably actuated at selected points in time during operation of free piston engine 90 to effect the high pressure pulse of high pressure hydraulic fluid from high pressure hydraulic accumulator H, similar to the manner described above with regard to the embodiment shown in FIG. 1. Mini-servo pilot MSP is controllably actuated to provide the pressure necessary for controllably actuating mini-servo main spool MSS. The pulse of high pressure hydraulic fluid is provided to pressure chamber 50 for a duration which is either dependent upon time or a sensed position of piston 14. As the volume within pressure chamber 50 increases, the pressure correspondingly decreases, resulting in an opening of low pressure check valve LPC. Low pressure hydraulic fluid from low pressure hydraulic accumulator L thus flows into pressure chamber 50 during the compression stroke of piston 14. After combustion and during the return stroke of piston 14, the pressure within pressure chamber 50 increases, thereby causing low pressure check valve LPC to close and high pressure check valve HPC to open. The high pressure hydraulic fluid created within pressure chamber 50 during the return stroke of piston 14 is pumped through high pressure check valve HPC and into high pressure hydraulic accumulator H, thereby resulting in a net positive gain in the pressure within high pressure hydraulic accumulator H.

Figure 3:
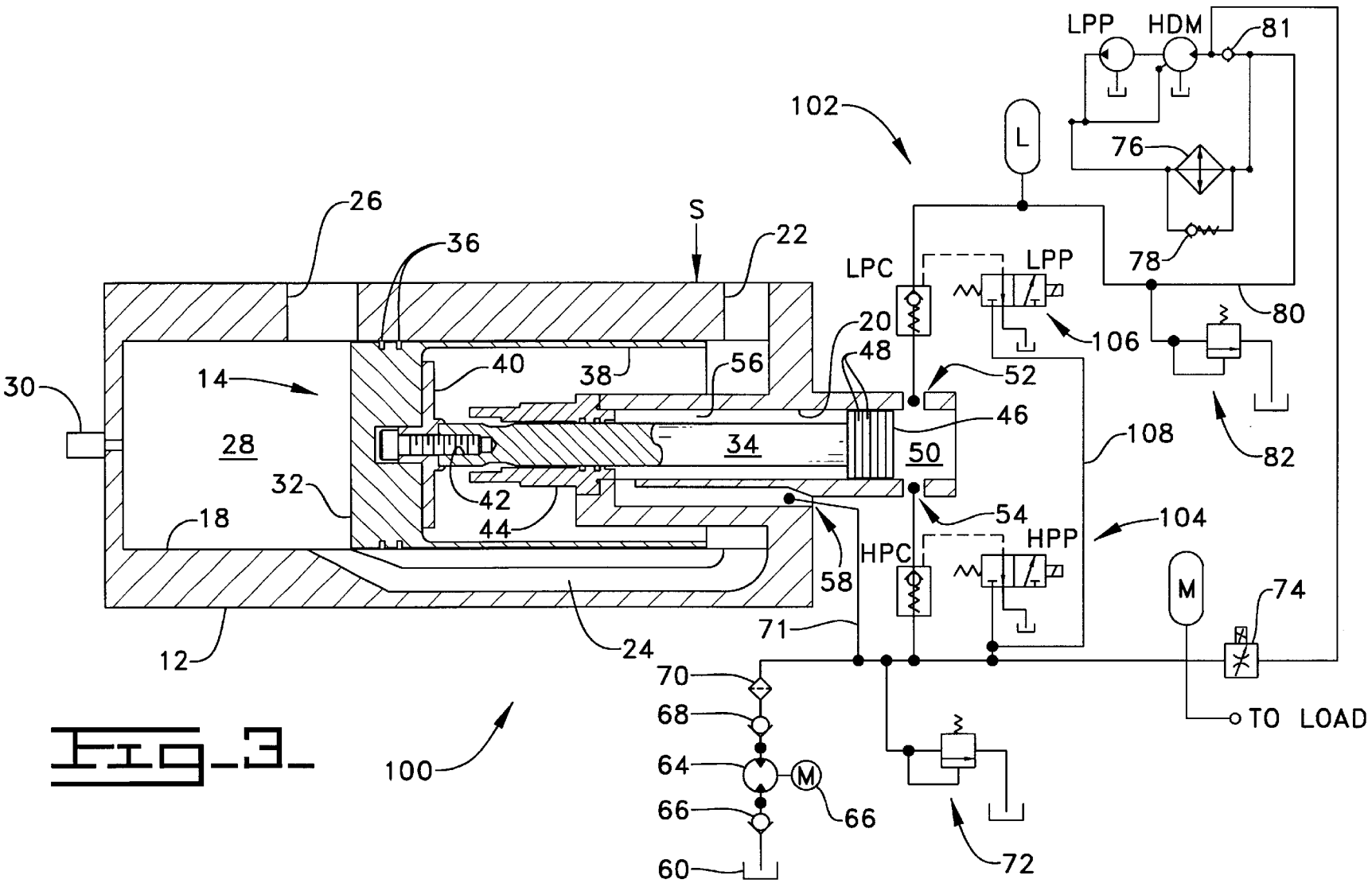
FIG. 3 is a schematic illustration of yet another embodiment of a free piston engine with which another embodiment of a method of the present invention may be used.

Referring now to FIG. 3 there is shown yet another embodiment of a free piston engine 100 with which the method of the present invention may be used. Again, the arrangement of combustion cylinder 18 and piston 14 is substantially the same as the embodiment of free piston engines 10 and 90 shown in FIGS. 1 and 2. Hydraulic circuit 102 also likewise includes many hydraulic components which are the same as the embodiments of hydraulic circuits 16 and 92 shown in FIGS. 1 and 2. However, hydraulic circuit 102 includes two pilot operated check valves 104 and 106. Pilot operated check valve 104 includes a high pressure check valve HPC and a high pressure pilot valve HPP which operate in a manner similar to high pressure check valve HPC and high pressure pilot valve HPP described above with reference to the embodiment shown in FIG. 1. Pilot operated check valve 106 includes a low pressure check valve LPC and a low pressure pilot valve LPP which also work in a manner similar to high pressure check valve 104. The input side of low pressure pilot valve LPP is connected with the high pressure fluid within high pressure hydraulic accumulator H through line 108. Low pressure pilot valve LPP may be controllably actuated using a controller to provide a pulse of pressurized fluid to low pressure check valve LPC which is sufficient to open low pressure check valve LPC.

During use, a pulse of high pressure hydraulic fluid may be provided to pressure chamber 50 using pilot operated check valve 104 to cause piston 14 to travel toward a TDC position with enough kinetic energy to effect combustion. High pressure pilot valve HPP is deactuated, dependent upon a period of time or a sensed position of piston 14, to thereby allow high pressure check valve HPC to close. As plunger head 46 moves toward the TDC position, the pressure within pressure chamber 50 decreases and low pressure check valve LPC is opened. Low pressure hydraulic fluid thus fills the volume within pressure chamber 50 while the volume within pressure chamber 50 expands. After combustion, piston 14 moves toward a BDC position which causes the pressure within pressure chamber 50 to increase. The increase causes low pressure check valve LPC to close and high pressure check valve to open. The high pressure hydraulic fluid which is generated by the pumping action of plunger head 46 within hydraulic cylinder 20 flows into high pressure hydraulic accumulator H, resulting in a net positive gain in the pressure within high pressure hydraulic accumulator H. A sensor (schematically illustrated and positioned at S) detects piston 14 near a BDC position. The high pressure pulse to effect the compression stroke can be timed dependent upon the sensor activation signal.

To effect a manual return procedure using the embodiment of free piston engine 100 shown in FIG. 3, high pressure hydraulic fluid is provided into annular space 56 from high pressure hydraulic accumulator H. Low pressure pilot valve LPP is controllably actuated to cause low pressure check valve LPC to open. The pressure differential on opposite sides of plunger head 46 causes piston 14 to move toward a BDC position. When piston 14 is at a position providing an effective compression ratio to effect combustion within combustion chamber 28, a high pressure pulse of hydraulic fluid is transported into pressure chamber 50 using pilot operated check valve 104 to begin the compression stroke of piston 14.

Figure 4:
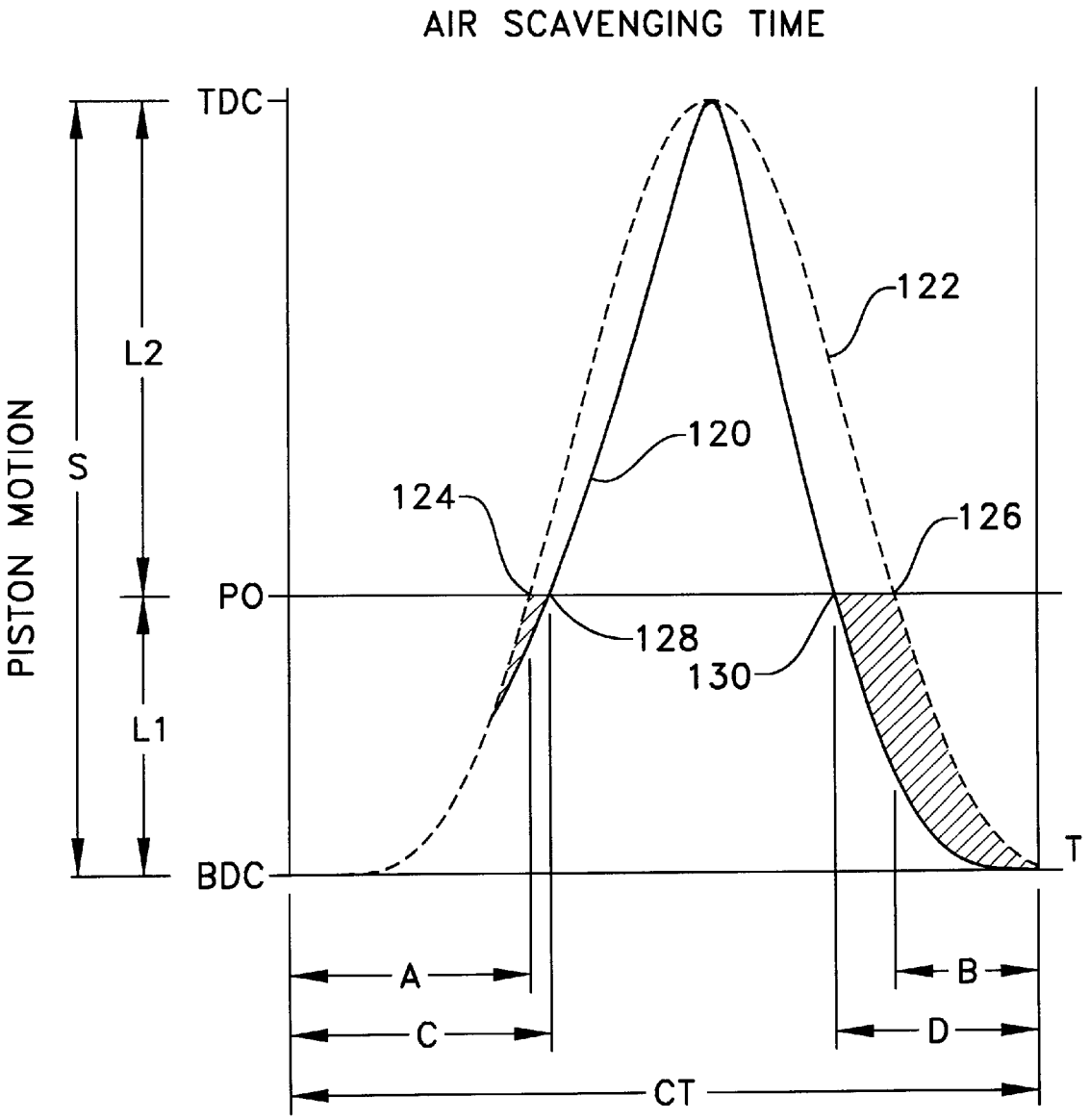
FIG. 4 is a graphic illustration of a comparison between the piston motion of a free piston engine operated in accordance with the present invention and a crankshaft engine operating at a same frequency.

Referring now to FIG. 4, an embodiment of the method of the present invention for operating a free piston engine will be described in greater detail. In the embodiment shown in FIG. 4, the method is assumed to be carried out using free piston engine 10 shown in FIG. 1. However, it will be appreciated that the embodiment of the method shown in FIG. 4 is equally applicable to other embodiments of a free piston engine, such as free piston engines 90 and 100 shown in FIGS. 2 and 3.

FIG. 4 illustrates the motion of a piston (trace 120) in free piston engine 10 used to carry out an embodiment of the method of the present invention when compared with the motion of a piston (trace 122) in a conventional crankshaft engine. For each of traces 120 and 122, the piston is assumed to have an identical stroke length between a BDC position and a TDC position, and operates at a same frequency. The frequency corresponds to a cycle time period CT during is which the piston moves from a BDC position to a TDC position, and back to a BDC position. Additionally, for comparison purposes, the cylinder of free piston engine 10 and the conventional crankshaft engine is assumed to have an air scavenging port positioned at approximately the same distance from the TDC position. Above the horizontal line referenced PO the air scavenging port closes, and below line PO the air scavenging port opens. The distance L1 between the TDC position and the edge of the air scavenging port (at which point in time air scavenging begins) is approximately between 60 and 80% of stroke length S, and preferably is about 70% of stroke length S. Accordingly, the distance L2 representing the distance between the BDC position and the edge of the air scavenging port closest to the TDC position is preferably approximately 30% of stroke length S.

For the piston motion of a conventional crankshaft engine represented by trace 122, the air scavenging port closes at point 124 during a compression stroke and opens at point 126 during a return stroke. Thus, the total air scavenging time for a conventional crankshaft engine is represented by the sum of the times A+B. Similarly, for free piston engine 10, air scavenging port 24 closes at point 128 during a compression stroke and opens at point 130 during a return stroke. The total air scavenging time for free piston engine 10 is thus represented by the sum of times C+D. As is apparent, the value of the air scavenging time C+D for free piston engine 10 is considerably larger than the value of the air scavenging time A+B for a conventional crankshaft engine. This is primarily because the slope of trace 120 for free piston engine 10 is considerably steeper than the slope of trace 122 for a conventional crankshaft engine. With a conventional crankshaft engine, a plurality of pistons are ganged together on a common crankshaft which rotates at a particular rotational speed. The movement of each piston is limited by the rotational speed of the crankshaft. On the other hand, piston 14 of free piston engine 10 is not connected with a crankshaft and therefore is not limited by the rotational speed of a crankshaft. The slope of trace 120 for free piston engine 10 is therefore considerably steeper than the slope of trace 122 for a conventional crankshaft engine.

The air scavenging time C+D of free piston engine 10 is controlled to be between 50 and 70% of cycle time period CT. Preferably, the air scavenging time C+D is between 55 and 60% of cycle time period CT, and more preferably is approximately 60% of cycle time period CT. Since piston 14 is not connected with or constrained by the rotational speed of a crankshaft, the air scavenging time C+D can be easily regulated. A supply of high pressure fluid can be pulsed into hydraulic chamber 50 to move piston 14 from the BDC position to the TDC position during a compression stroke. Firing occurs at or near the TDC position and piston 14 is moved back to the BDC position during a return stroke. If the time period D allows sufficient air scavenging, free piston engine 10 can be pulsed at or near the BDC position to start a new cycle time period CT. On the other hand, the air scavenging time D during a return stroke can be easily increased by simply holding free piston engine 10 an additional period of time before pulsing free piston engine 10 at or near the BDC position.

Free piston engine 10 is operated with a bore/stroke ratio which is higher than conventional crankshaft engines and conventional free piston engines. The bore/stroke ratio is represented by the quotient of the inside bore diameter $D_B$ of combustion chamber 18 divided by stoke length S of piston 14 between a TDC position and a BDC position. With a conventional crankshaft engine, the bore/stroke ratio typically does not exceed 1 since it is believed that adequate air scavenging will not occur if stroke length S has a shorter length relative to the bore diameter $D_B$. Moreover, conventional free piston engines include a housing with a combustion chamber, a compression chamber and a hydraulic chamber. The piston likewise includes a piston head, a compression head and a plunger head which are respectively disposed in the combustion chamber, compression chamber and the hydraulic chamber. The amount of fluid energy which is pulsed into the compression chamber of a conventional free piston engine is directly related to the kinetic energy of the piston needed for combustion. The kinetic energy of the piston is a function of the mass and velocity of the piston. Since the mass of a piston in a conventional free piston engine is much heavier as a result of the additional compression head, the velocity of the piston is correspondingly much lower. This means that the frequency and cycle time period CT are much slower and the stroke length is longer for a conventional free piston engine when compared with free piston engine 10 shown in FIG. 1. Thus, the bore/stroke ratio is higher for conventional free piston engines.

Figure 5:
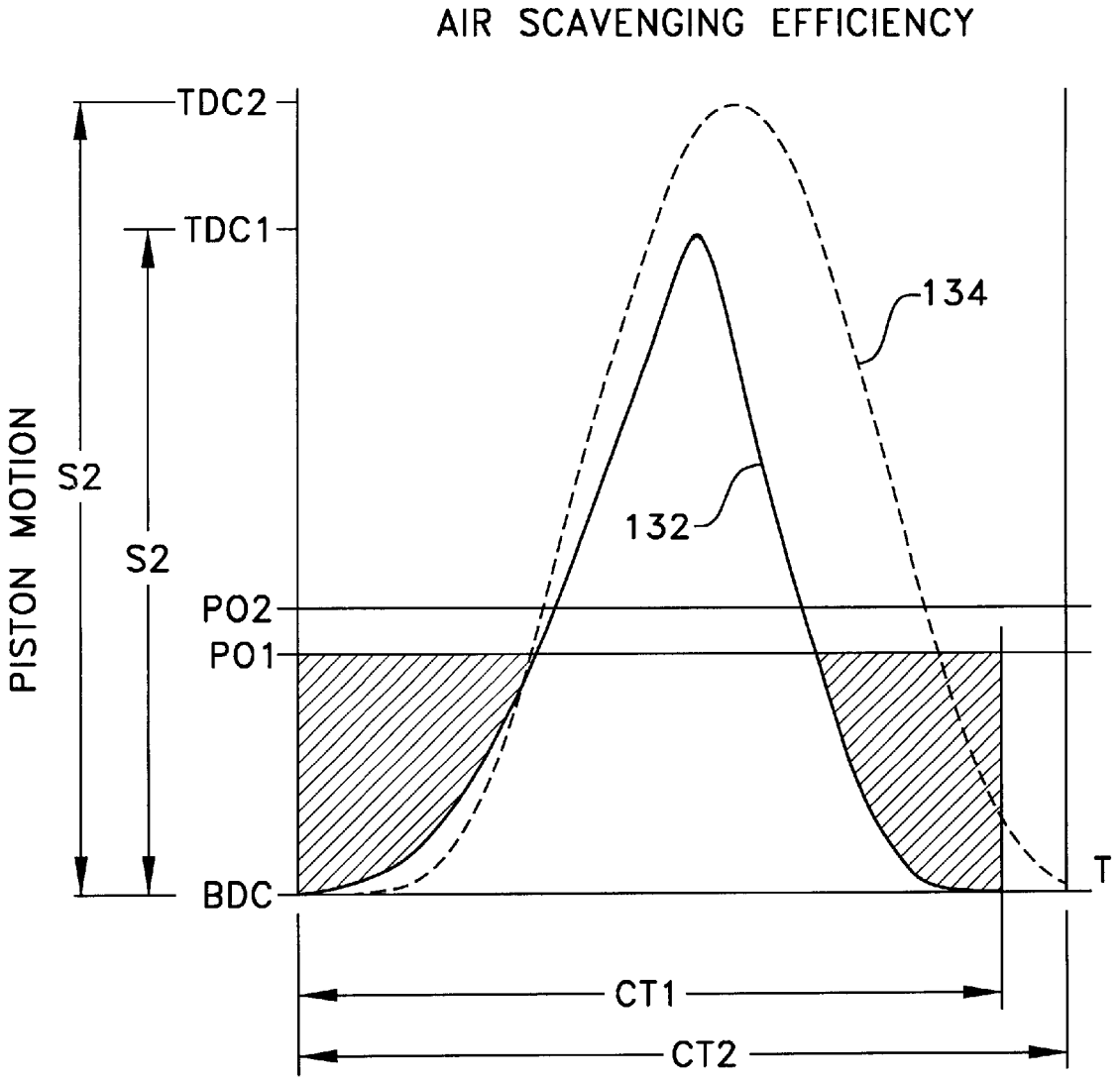
FIG. 5 is a graphic illustration of the air scavenging time for a free piston engine operated in accordance with the present invention and a crankshaft engine, when the free piston engine is operating at a higher frequency than the crankshaft engine.

FIG. 5 illustrates the air scavenging efficiency (trace 132) of free piston engine 10 when compared with the air scavenging efficiency (trace 134) of a conventional crankshaft engine. Piston 14 of free piston engine 10 is not constrained by the rotational speed of a crankshaft. Accordingly, free piston engine 10 is operated at a frequency corresponding to cycle time period CT1 which is much higher than a frequency corresponding to cycle time period CT2 of a conventional crankshaft engine. To operate at a higher frequency corresponding to cycle time period CT1, the stroke length S1 of free piston engine 10 is shortened relative to a stroke length S2 of the conventional crankshaft engine. Since the stroke length S1 is shorter than the stroke length S2, the leading edge of air scavenging port 24 is moved closer to the BDC position so that the air scavenging port is still in communication with combustion chamber 28 approximately 30% of stroke length S1. The air scavenging time of free piston engine 10 operating at a higher frequency is thus represented by the area under the horizontal line P01. Similarly, the air scavenging time of the conventional crankshaft engine is represented by the area under the horizontal line P01. As may be easily observed from the graphical illustration of FIG. 5, the air scavenging time represented by the area under line P01 for free piston engine 10 is similar to the air scavenging time represented by the area under line P02 for a conventional crankshaft engine. Thus, free piston engine 10 may be operated at a substantially higher frequency without substantially effecting the air scavenging efficiency of the engine. Operating free piston engine 10 at a higher frequency means that more output energy can be provided over a given period of time, which in turn means that free piston engine 10 can provide a higher power output than a conventional crankshaft engine.

Free piston engine 10 also may be operated at a frequency which is higher than conventional free piston engines since free piston engine 10 includes a piston 14 with only two heads, rather than three. The mass of piston 14 is considerably lighter than a piston in a conventional free piston engine, which in turn means that the frequency can be much higher and the cycle time period CT can be much shorter. The relationship of the air scavenging efficiency of free piston engine 10 shown in FIG. 5 also holds true when compared with the air scavenging efficiency of a conventional free piston engine since a conventional free piston engine operates at a slower frequency and longer stroke length.

Industrial Applicability

During use, piston 14 is reciprocally disposed within combustion cylinder 16. Piston 14 travels between a BDC position and a TDC position during a compression stroke and between a TDC position and a BDC position during a return stroke. Combustion air is introduced into combustion chamber 28 through combustion air inlet 22 and air scavenging channel 24. Fuel is controllably injected into combustion chamber 28 using a fuel injector 30. High pressure hydraulic fluid from high pressure hydraulic accumulator H is coupled with pressure chamber 50 during a return stroke of piston 14. A duration of time during which the high pressure hydraulic fluid is coupled with the pressure chamber is dependent upon the activation of a sensor S which senses piston 14 at or near a BDC position. If free piston engine 10 misfires and sensor S is not activated, then the high pressure hydraulic fluid is maintained in a coupled relationship with pressure chamber 50 to cause piston 14 to bounce back toward the TDC position, thereby increasing the energy within the non-combusted fuel and air mixture within combustion chamber 28 during a next compression stroke and likely causing combustion of the fuel and air mixture. If the misfire occurs for several cycles of the free piston engine corresponding to a preset total amount of time, a manual return procedure is initiated to retract piston 14 to a position allowing firing of the free piston engine.

Free piston engine 10 has a stroke length S which is shorter than conventional free piston engines and conventional crankshaft engines. Additionally, free piston engine 10 operates at a frequency which is substantially higher than conventional free piston engines or crankshaft engines, while at the same time maintaining a similar air scavenging efficiency. Thus, free piston engine 10 may be provided with a higher power density without degrading the air scavenging efficiency thereof.

Other aspects, objects and advantages of this invention can be obtained from a study of the drawings, the disclosure and the appended claims.

What is claimed is:

1. A method of operating a free piston internal combustion engine, comprising the steps of:

providing a housing including a combustion cylinder and a second cylinder, said combustion cylinder having a bore with an inside diameter;

providing a piston including a piston head reciprocally disposed within said combustion cylinder, a second head reciprocally disposed within said second cylinder, and a plunger rod interconnecting said piston head with said second head; and moving said piston between a top dead center position and a bottom dead center position during a return stroke, said return stroke having a stroke length between said top dead center position and said bottom dead center position, said moving step being carried out with a bore/stroke ratio represented by a quotient of said inside diameter divided by said stroke length which is between 1.2 and 1.5.

2. The method of claim 1, wherein said moving step is carried out with a bore/stroke ratio of between 1.3 and 1.5.

3. The method of claim 2, wherein said moving step is carried out with a bore/stroke ratio of approximately 1.5.

4. The method of claim 1, wherein said second cylinder comprises a hydraulic cylinder and said second head comprises a plunger head.

5. The method of claim 1, wherein said combustion cylinder includes an air scavenging port, said air scavenging port being in communication with said bore during approximately 30 percent of said stroke length which is closest to said bottom dead center position.

6. The method of claim 5, wherein said air scavenging port is in communication with said bore a period of time which is sufficient to allow adequate scavenging of combustion air into said bore.

7. A method of operating a free piston internal combustion engine, comprising the steps of:

providing a housing including a combustion cylinder and a second cylinder, said combustion cylinder having a bore and an air scavenging port in communication with said bore;

providing a piston including a piston head reciprocally disposed within said combustion cylinder, a second head reciprocally disposed within said second cylinder, and a plunger rod interconnecting said piston head with said second head; and moving said piston from a bottom dead center position to a top dead center position and back to said bottom dead center position during a cycle time period, said piston head opening and closing said air scavenging port during said movement of said piston, said air scavenging port being in fluid communication with said bore during between 50 and 70 percent of said cycle time period.

8. The method of claim 7, wherein said air scavenging port is in fluid communication with said bore during between 55 and 60 percent of said cycle time period.

9. The method of claim 8, wherein said air scavenging port is in fluid communication with said bore approximately 60 percent of said cycle time period.

10. The method of claim 7, wherein said bore has an inside diameter, and said movement of said piston between said top dead center position and said bottom dead center position is during a return stroke, said return stroke having a stroke length between said top dead center position and said bottom dead center position, said moving step being carried out with a bore/stroke ratio represented by a quotient of said inside diameter divided by said stroke length which is between 1.2 and 1.5.

11. The method of claim 10, wherein said moving step is carried out with a bore/stroke ratio of between 1.3 and 1.5.

12. The method of claim 11, wherein said moving step is carried out with a bore/stroke ratio of approximately 1.5.

13. The method of claim 7, wherein said second cylinder comprises a hydraulic cylinder and said second head comprises a plunger head.

* * * * *